US005372151A

United States Patent [19]

Kuo

[11] Patent Number: 5,372,151

[45] Date of Patent: Dec. 13, 1994

[54] BAND AND METHOD OF MAKING SAME

[76] Inventor: Chu C. Kuo, No. 20, Alley 95, Lane 113, East Hu Road, Nei Hu, Taipei, Taiwan, Prov. of China

[21] Appl. No.: 116,412

[22] Filed: Sep. 3, 1993

[51] Int. Cl.[5] ..... A45D 24/00

[52] U.S. Cl. ..... 132/200; 132/273

[58] Field of Search ..... 132/200, 53, 56, 273, 132/275; 2/174, 162, 169, 170; 87/2, 8

[56] References Cited

U.S. PATENT DOCUMENTS

| | | | |
|---|---|---|---|
| D. 292,030 | 9/1987 | Revson . | |
| D. 300,675 | 4/1989 | Sacher . | |
| D. 315,036 | 2/1991 | Leopold . | |
| D. 336,544 | 6/1993 | Maturaporn . | |
| 423,713 | 3/1890 | Ashworth | 87/2 |
| 1,712,017 | 5/1929 | Aoyama | 87/8 |
| 3,866,512 | 2/1975 | Berger | 87/8 |
| 5,044,385 | 9/1991 | Rhodes . | |
| 5,156,171 | 10/1992 | Goodman . | |
| 5,230,355 | 7/1993 | Weingrod . | |

*Primary Examiner*—Gene Mancene
*Assistant Examiner*—Frank A. LaViola
*Attorney, Agent, or Firm*—Harness, Dickey & Pierce

[57] ABSTRACT

A method of producing a decorative generally cylindrical band is provided. This method generally involves arranging a plurality of elongated pliable members such that they equiangularly extend in a radially outward direction from a common center. A first member is then folded over any adjacent members such that the direction in which the first member extends is shifted by approximately $\Theta+\Theta/2°$, where $\Theta$ is the angle defined between any two adjacent pliable members. The next member is then folded over any adjacent members such that it extends in a direction which is shifted approximately $\Theta+\Theta/2°$. This braiding process continues until each of the pliable members except the last has been folded. The last pliable member is then folded over any adjacent members and under the first member such that the last member also extends in a direction which is shifted approximately $\Theta+\Theta/2°$. These steps are continued until a desired length of band is attained. Once this length has been attained, free ends of the band can be attached to one another to form a decorative braided fashion item.

16 Claims, 2 Drawing Sheets

BAND AND METHOD OF MAKING SAME

BACKGROUND OF THE INVENTION

1. Technical Field

The present invention relates generally to decorative bands and, more particularly, to a decorative braid which can be utilized as a hair band, and a method for making the same.

2. Discussion

As is well known in the art, hair bands or "pony tail holders" are generally ring shaped elastic members used to hold strands of hair such as a "pony tail". Hair bands are often ornamental or decorative to enhance the aesthetic appearance of both the band and the person wearing it. For example, elastic hair bands surrounded by a gathered fabric are particularly trendy. These types of hair bands are typically made by creating a tubular fabric ring having an elastic member slidingly contained within the tubular ring. The tubular ring, when fully extended, is very much longer than the elastic ring in its unstretched condition. Accordingly, the fabric becomes tightly gathered when the elastic ring is allowed to contract. Thus, when the fabric ring is circumferentially stretched in order to draw the pony tail through the ring and is thereafter released and allowed to contract upon the strands of hair, the fabric becomes gathered into many folds and undulations, thereby providing a decorative effect.

In order to further enhance the appearance of this type of decorative hair band, it would be desirable to provide a unique braid for use as a hair band which is relatively easy to use and produce. Likewise, it would also be desirable to provide a decorative braid for use as wrist bands, head bands or other fashionable items.

SUMMARY OF THE INVENTION

A unique braid having an enhanced decorative appearance is provided. This braid is created by weaving a plurality of pliable members as follows. The pliable members are first arranged such that they equiangularly extend in a radially outward direction from a center point. A first pliable member is then folded over any adjacent members such that this first member extends in a direction shifted by approximately $\Theta+\Theta/2°$—where $\Theta$ is the angle defined between any two pliable members. Thereafter, a next pliable member is folded in the same direction over any adjacent members such that it extends in a direction which is shifted by approximately $\Theta+\Theta/2°$. This folding process is continued until the last pliable member is reached. This last member is folded over any adjacent members and under the first pliable member such that it extends in a direction which is shifted by approximately $\Theta+\Theta/2°$. This folding pattern creates a decorative segment of the braid and is repeated until enough longitudinally spaced segments are created and the desired length of braid is attained. In a preferred embodiment of the present invention, the free ends of the braid are attached to one another in order to create a ring shaped hair band.

DETAILED DESCRIPTION OF THE DRAWINGS

Additional objects, advantages, and features of the present invention will become apparent from the following description and appended claims, taken in conjunction with the accompanying drawings in which:

DETAILED DESCRIPTION OF THE PREFERRED EMBODIMENT

Figure 1:
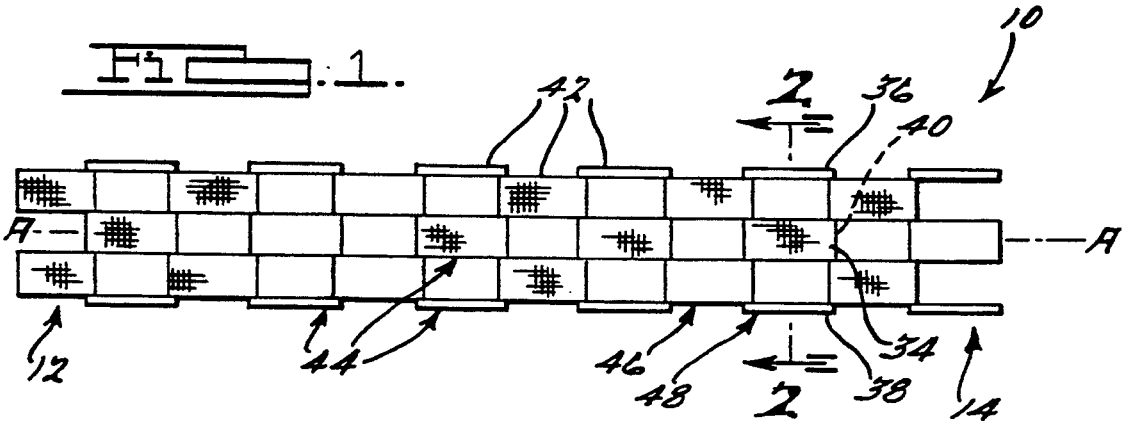
FIG. 1 is a plan view of a portion of a braid of the present invention.
Figure 3:
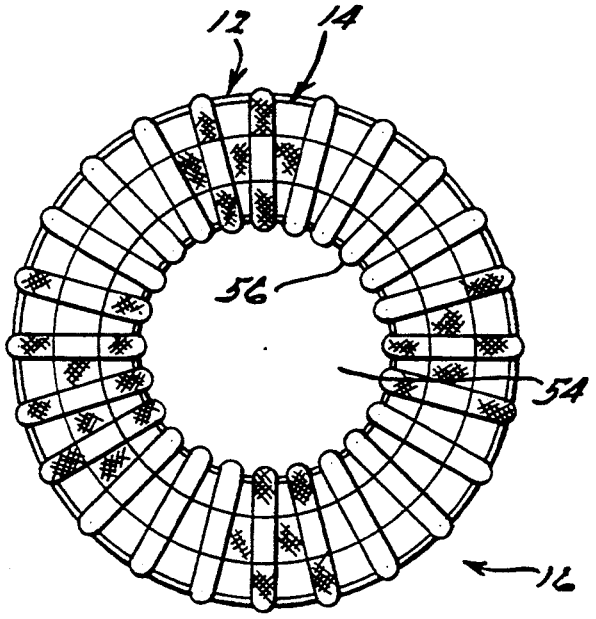
FIG. 3 is a plan view of a hair band made from a braid in accordance with the principles of the present invention.

Referring now to the drawings and in particular to FIG. 1, a portion of a braid 10 of the present invention is shown. As can be seen from FIG. 1, this braid 10 provides a unique decorative pattern which is aesthetically pleasing to the eye. While this decorative braid 10 can be used for many ornamental purposes, a preferred embodiment of the braid 10 is illustrated in FIG. 3 where free ends 12 and 14 of the braid 10 are attached to one another in order to form a ring shaped hair band 16. This unique hair band 16 is highly attractive and is a particularly desirable fashion item. Similar items can also be created from the braid 10 such as head bands, wrist bands and the like (not shown).

Figure 4:
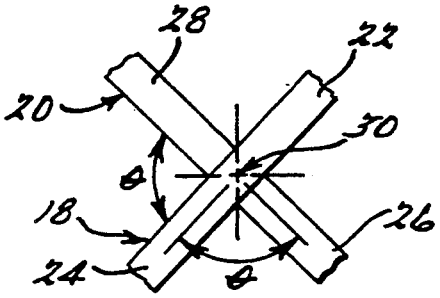
FIGS. 4–12 are step-by-step diagrammatic illustrations of the folding patterns used for creating the braid of the present invention.

FIGS. 4–12 illustrate a preferred embodiment of the novel braiding process by which the braid 10 of the present invention is created. As shown in FIG. 4, the first step in creating the braid is to arrange a pair of elongated members 18 and 20 such that pliable free ends 22 and 24 of member 18 and pliable free ends 26 and 28 of member 20 extend linearly through a common center 30 such that each of the free ends 22, 24, 26 and 28 equiangularly extend in a radially outward direction from the center 30. In this particular embodiment, since there are four equiangularly spaced free ends, 22, 24, 26 and 28, the free ends are perpendicular to one another, i.e., the angular relationship between the free ends is 90°. In general, this angular relationship is defined by the angle $\Theta$ which is constant between any two equiangular spaced free ends 22, 24, 26 or 28.

Figure 5:
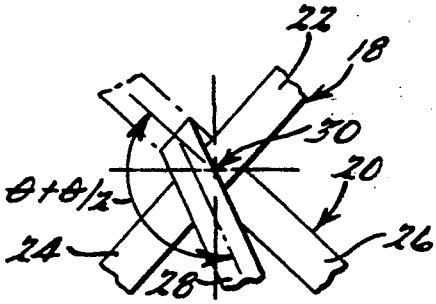
Figure 6:
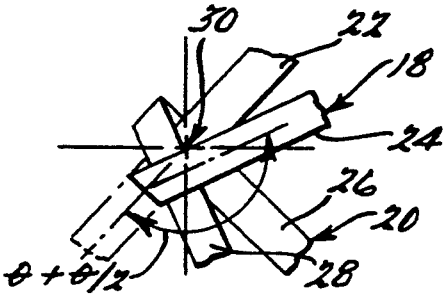
Figure 7:
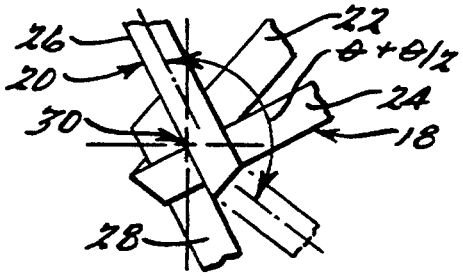
Figure 8:
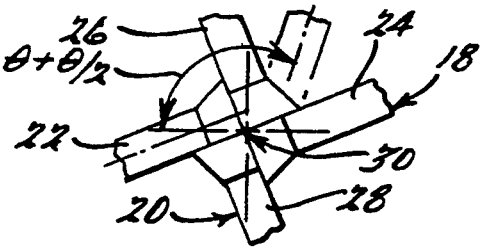

As shown in FIG. 5, the next step in the method of making the decorative braid 10 is to fold free end 28 over adjacent free end 24 such that after being folded, free end 28 extends in a direction shifted approximately by the angle $\Theta+\Theta/2°$. In this particular embodiment, the direction of free end 28 is shifted approximately 135°. As shown in FIG. 6, the next step is to fold free end 24 over adjacent members 28 and 26 such that free end 24 extends in a direction shifted approximately $\Theta+\Theta/2°$. Likewise, FIG. 7 illustrates that the next step is to fold free end 26 over adjacent free ends 24 and 22 such that free end 26 extends in a direction shifted approximately $\Theta+\Theta/2°$. Thereafter, as shown in FIG. 8, free end 22 is folded over adjacent free end 26 and under free end 28 such that free end 22 extends in a direction shifted approximately $\Theta+\Theta/2°$. At this point, shown in FIG. 8, a first free end 12 of the braid 10 is completed and serves as a starting point for repetitively weaving a unique braiding pattern until the desired length of the braid 10 has been achieved.

Figure 9:
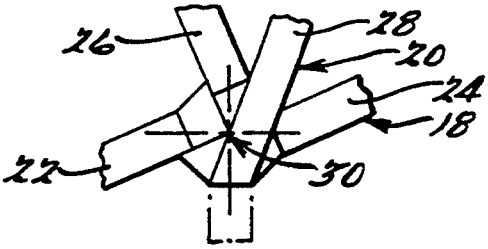
Figure 10:
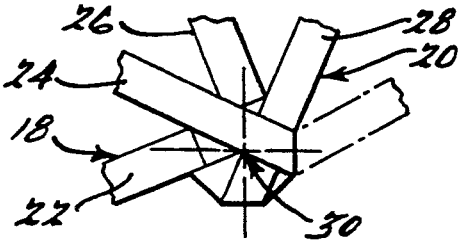
Figure 11:
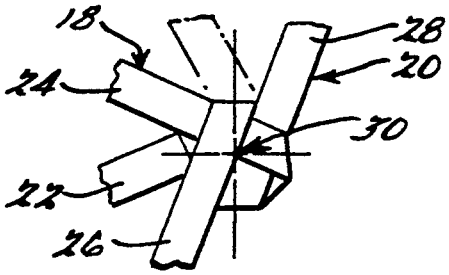

The unique repetitive weaving pattern of the present invention is demonstrated by viewing FIGS. 9–12. As shown in FIG. 9, the first step in the repetitive braiding pattern is to fold free end 28 over adjacent free end 24 such that free end 28 extends in a direction between free ends 24 and 26. Once again, this results in a shift in direction of approximately $\Theta+\Theta/2°$ from the direction in which free end 28 extended prior to being folded. As shown in FIG. 10, the next step is to fold free end 24 over adjacent members 28 and 26 such that it extends in a direction between free ends 22 and 26 (shifted approximately $\Theta+\Theta/2°$). FIG. 11 illustrates the next step which is to fold free end 26 over adjacent free ends 24 and 22 such that free end 26 extends in a direction away from free end 28 generally parallel thereto. The last step in the repetitive braiding pattern is to fold free end 22 over adjacent free end 26 and under free end 28 such that free end 22 extends in a direction generally perpendicular to free ends 26 and 28.

Figure 2:
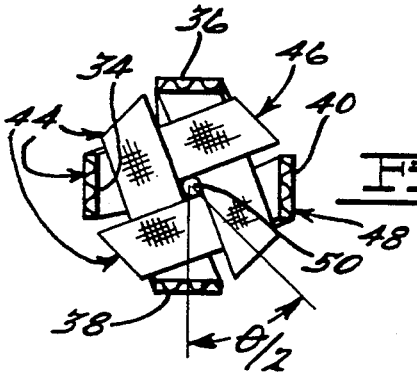
FIG. 2 is a cross sectional view taken through section 2—2 in FIG. 1 illustrating pliable members within the braid being equiangularly spaced from one another at the periphery of the braid in accordance with the principles of the present invention.
Figure 12:
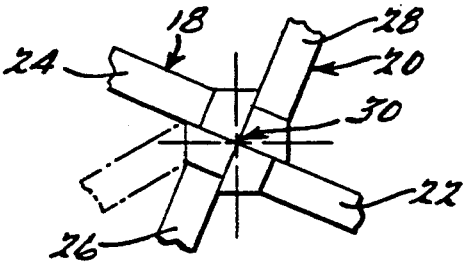

Upon completion of the last step, illustrated in FIG. 12, the braiding pattern can be repeated. Thus, if additional length is desired to be added to the braid 10, the steps shown in FIGS. 9–12 can be repeated until the desired length of the braid 10 is attained. As best shown in FIGS. 1 and 2, once the desired length is attained, the decorative braid 10 is generally cylindrical and a central longitudinal axis A—A extends axially along a center portion. When the decorative braid 10 is completed, free ends 22, 24, 26 and 28 form a second free end 14 of the braid 10 which is simply connected to the first free end 12 to create an annular band. The free ends 12 and 14 are connected in a conventional manner such as by bonding, tieing, sewing, adhesives, velcro, inner-weaving or the like.

The embodiment depicted in FIG. 2 illustrates a braid 10 formed by this unique braiding process having pliable members 34, 36, 38 and 40. As discussed previously, the length of the braid is determined by the number of times the braiding pattern is repeated. Each time the braiding pattern is completed, an identical segment 42 is created. Each of these segments 42 is longitudinally spaced along the central axis A—A and is created by portions 44 of each of the pliable members 34, 36, 38 and 40. As shown in FIG. 2, these portions 44 are equiangularly spaced at an angle $\Theta$ from one another at the periphery of the braid 10. Moreover, adjacent segments 42 have the appearance of being rotated about the central axis A—A by $\Theta/2$ relative to one another, thereby yielding the pattern of the braid 10 as shown in FIGS. 1 and 2. In other words, every other segment 42 has the appearance of having the same orientation.

FIG. 2 further illustrates that each of the pliable members 34, 36, 38 and 40 are interwoven with one another in an interlocking manner in order to avoid one pliable member slipping or "running" with respect to the other pliable members. For example, FIG. 2 shows that pliable member 34 extends upwardly from a lower segment 46 and is folded over adjacent pliable member 40. Pliable member 34 then passes under adjacent pliable member 34 before extending upwardly to become a portion 44 of upper segment 48. Thus, pliable member 36 both engages and interlocks with adjacent pliable members 40 and 34 between segments 46 and 48.

Figure 13:
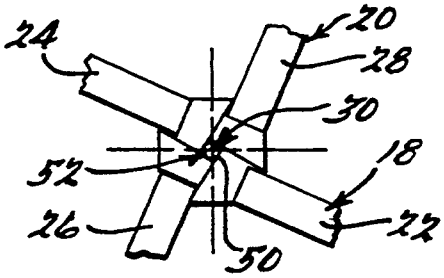
FIG. 13 is a diagrammatic illustration similar to FIG. 12 illustrating an elastic member extending through an opening along the central axis of the braid of the present invention.

In addition to the interlocking ability of this unique braid pattern, an opening 50 is also created along the central axis A—A as a result of the pattern. This opening 50 as shown in FIGS. 2 and 13, is capable of receiving an elongated member for disposal within the braid 10. In a preferred embodiment, an elastic band 52 is disposed within the opening 50, as shown in FIG. 13, thereby providing elasticity to the ring shaped hair band 16 depicted in FIG. 3. Thus, the ring shaped hair band 16 can be circumferentially expanded allowing the user to draw strands of hair through the opening 54 within the band 16 before releasing the band and allowing the elastic member 52 to relax and circumferentially engage the strands of hair at an inner surface 56 of the band 16. Likewise, elastic bands 52 can be utilized in head bands, wrist bands and the like (not shown).

Figure 14:
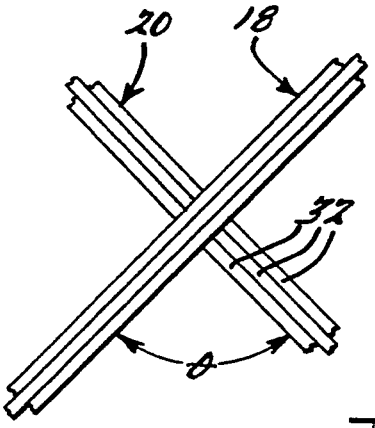
FIG. 14 is a diagrammatic illustration similar to FIG. 4 illustrating groups of elongated members being used as pliable members in accordance with the principles of the present invention.

In order to further enhance the aesthetic appearance of the braid 10, a number of variations in the elongated pliable members 18 and 20 can be employed. For example, a number of different materials including, but not limited to, ribbon, rope, leather, metal, plastic, shoe lace, wood, clay, strings of beads, fabric, hemp or the like can be utilized as elongated members 18 and 20. Braids created from these different materials provide a wide variety of unique braid configurations and styles. In addition, an alternative embodiment of the elongated members 18 and 20 is shown in FIG. 14. In this embodiment, elongated members 18 and 20 are created by a plurality of members 32 which extend side by side and parallel to one another to provide an even wider variety of configurations and styles. Moreover, elongated members 18 and 20 of various color schemes and patterns can be implemented to further enhance the aesthetic appearance of the braid 10.

In short, the novel braid 10 of the present invention is readily made from a wide variety of materials at relatively low cost. When completed, free ends of the braid can be attached to create a variety of fashion items which preferably include ornamental hair bands, head bands, wrist bands and the like. The unique and aesthetically pleasing appearance of these fashion items offers a refreshing change from similar existing items.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

I claim:

1. A decorative band comprising at least four pliable members interwoven with one another to form a generally cylindrical braid having a central axis, said four pliable members being repetitively woven in a pattern such that each repetition creates a segment, each of said segments being created by a portion of each of said pliable members, said portions being equiangularly spaced by an angle of approximately $\Theta$ at the periphery of said segments and each of said segments interlocking end to end with one another along said central axis, each of said segments further being rotated about said central axis by an angle of approximately $\Theta/2$ with respect to adjacent segments.

2. The decorative braid of claim 1 wherein each of said pliable members includes a plurality of members which extend side by side and generally parallel to one another to form said pliable member.

3. The decorative braid of claim 1 wherein said generally cylindrical braid has a first end and a second end, said first and second ends being affixed to one another to create a ring shaped decorative band.

4. The decorative braid of claim 3 wherein said pliable members are made of an elastic material such that said ring shaped band can be temporarily circumferentially expanded for inserting an object through said ring shaped band.

5. The decorative braid of claim 1 wherein an elastic member is disposed within said generally cylindrical braid along said central axis such that said braid expands and contracts with said elastic member.

6. A method of making a decorative band from at least four elongated pliable members, each of said pliable members having a free end which extends from an end portion of said band, said method comprising the steps of:

a) arranging said elongated pliable members such that free ends of said members equiangularly extend in a radially outward direction from said end portion of said band, thereby defining a constant angle $\Theta$ between any two adjacent members;

b) folding a first member extending in a first direction over any adjacent members such that said first member extends in a direction shifted approximately $\Theta+\Theta/2$ degrees from said first direction;

c) folding a next member in the same direction as said first member over any adjacent members such that said next member extends in a direction which is shifted approximately $\Theta+\Theta/2$ degrees;

d) continuing step c until a last member is reached;

e) folding said last member over any adjacent members and under said first member such that said last member extends in a direction which is shifted approximately $\Theta+\Theta/2$ degrees; and f) continuing steps b through e until a desired length of band is attained.

7. The method of claim 6 wherein said step of arranging said free ends of said pliable members involves creating an end portion for said band from said elongated pliable members.

8. The method of claim 6 wherein said step of arranging said elongated pliable members involves arranging a plurality of members side by side and generally parallel to one another such that said plurality of members forms one of said pliable members.

9. The method of claim 6 further comprising the step of:

(g) affixing free ends of said length of band to create a ring shaped band.

10. The method of claim 6 further comprising the step of:

(g) disposing an elastic member within said decorative band such that said band longitudinally expands and contracts with said elastic member.

11. A decorative band produced by the method of claim 6.

12. A method of making a braided hair band from first and second elongated pliable members having first and second free ends, said method comprising the steps of:

a) placing said first pliable member over said second pliable member such that said first and second ends of said first member and said first and second ends of said second member extend in directions which are generally perpendicular to one another;

b) folding said second end of said second member over said second end of said first member such that said second end of said second member extends in a direction between said first end of said second member and said second end of said first member;

c) folding said second end of said first member over said second end of said second member such that said second end of said first member extends in a direction between said first end of said first member and said first end of said second member;

d) folding said first end of said second member over said second end of said first member such that said first end of said second member extends in a direction away from said second end of said second member, generally parallel thereto;

e) folding said first end of said first member over said first end of said second member and under said second end of said second member such that said first end of said first member extends in a direction generally perpendicular to said first and second ends of said second member, whereby a first end of said braid is completed;

f) folding said second end of said second member over said end of said braid such that said second end of said second member extends in a direction between said second end of said first member and said first end of said second member;

g) folding said second end of said first member over said end of said braid such that said second end of said first member extends in a direction between said first end of said first member and said first end of said second member;

h) folding said first end of said second member over said end of said braid such that said first end of said second member extends in a direction away from said second end of said second member, generally parallel thereto;

i) folding said first end of said first member over said end of said braid such that said first end of said first member passes over said first end of said second member and under said second end of said second member and extends in a direction generally perpendicular to said first and second ends of said second member;

j) repeating steps f through i until a length of said braid is attained, whereby a second end of said braid is completed; and k) affixing said second end of said braid to said first end of said braid, thereby creating a hair band.

13. A braided hair band produced by the method of claim 12.

14. The method of claim 12 wherein said step of placing said first pliable member over said second pliable member involves utilizing elastic pliable members which permit said hair band to circumferentially expand and contract.

15. The method of claim 12 further comprising the step of:

(1) disposing an elastic member within said braided hair band such that said hair band circumferentially expands and contracts with said elastic member.

16. The method of claim 12 wherein said step of placing said first pliable member over said second pliable member involves utilizing first and second pliable members, each of which include a plurality of members which extend side by side and generally parallel to one another.

* * * * *